US006104282A

United States Patent [19]

Fragoso et al.

[11] Patent Number: 6,104,282

[45] Date of Patent: Aug. 15, 2000

[54] DAILY LOG DEVICE

[76] Inventors: Alvaro H Fragoso; Albert C Hinojosa, both of 850 10th St., P.O. Box 473, Douglas, Ariz. 85608

[21] Appl. No.: 09/325,804

[22] Filed: Jun. 4, 1999

[51] Int. Cl.[7] ..... G08B 1/00

[52] U.S. Cl. ..... 340/309.15; 340/438; 340/439; 340/425.5; 368/5; 368/10; 368/239

[58] Field of Search ..... 340/309.15, 439, 340/425.5, 438; 368/10, 5, 239

[56] References Cited

U.S. PATENT DOCUMENTS

| | | | |
|---|---|---|---|
| 4,338,512 | 7/1982 | Ludwig | 235/92 T |
| 4,403,869 | 9/1983 | Crutcher | 368/10 |
| 4,916,827 | 4/1990 | Rayburn . | |
| 5,184,303 | 2/1993 | Link . | |
| 5,274,561 | 12/1993 | Adams et al. . | |
| 5,485,141 | 1/1996 | Gregory | 340/457 |
| 5,525,958 | 6/1996 | Negishi et al. . | |
| 5,633,622 | 5/1997 | Patterson . | |

*Primary Examiner*—Jeffery A. Hofsass
*Assistant Examiner*—Hung Nguyen
*Attorney, Agent, or Firm*—Michael I. Kroll

[57] ABSTRACT

A daily log device for recording the daily activities of a driver. The daily log device includes a clock indicating a time and date, a first signal generator for generating a signal representative of the driver being on duty and a second signal generator for generating a signal representative of the driver being off duty. A microprocessor is connected to the clock, the first signal generator and the second signal generator and includes a memory. A printer is connected to the microprocessor for printing the daily log. The microprocessor stores a time and date at which the first signal generator is activated and a time and date at which second signal generator is activated in the memory and calculates a time period between activation of the first and second signal generators. The daily log indicates the time the first signal generator is activated, the time the second signal generator is activated and the calculated time between activation of the first and second signal generators. The first signal generator can also divide the on duty time between times the driver is on duty and driving and times the driver is on duty and not driving. These time periods will also be calculated by the microprocessor and printed on the daily log.

8 Claims, 9 Drawing Sheets

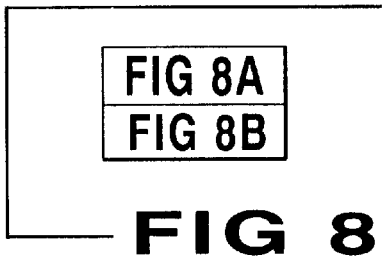
FIG 8A
FIG 8B
FIG 8

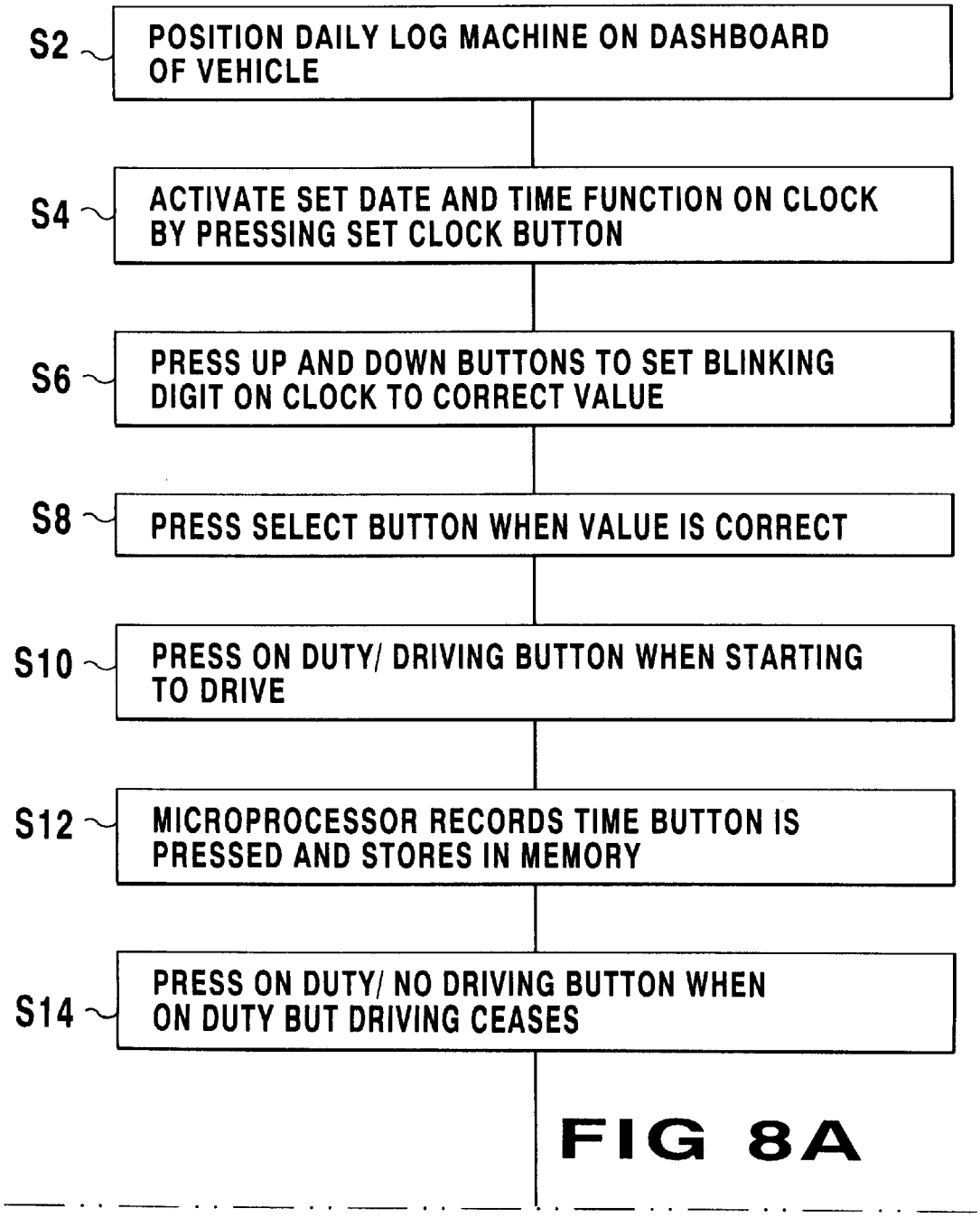
S2
POSITION DAILY LOG MACHINE ON DASHBOARD OF VEHICLE
S4
ACTIVATE SET DATE AND TIME FUNCTION ON CLOCK BY PRESSING SET CLOCK BUTTON
S6
PRESS UP AND DOWN BUTTONS TO SET BLINKING DIGIT ON CLOCK TO CORRECT VALUE
S8
PRESS SELECT BUTTON WHEN VALUE IS CORRECT
S10
PRESS ON DUTY/ DRIVING BUTTON WHEN STARTING TO DRIVE
S12
MICROPROCESSOR RECORDS TIME BUTTON IS PRESSED AND STORES IN MEMORY
S14
PRESS ON DUTY/ NO DRIVING BUTTON WHEN ON DUTY BUT DRIVING CEASES
FIG 8A

DAILY LOG DEVICE

BACKGROUND OF THE INVENTION

1. Field of the Invention

The present invention relates generally to log books for truck drivers and, more specifically, to a device for tracking the daily activities of employees required to keep a log book and printing a daily log of such activities.

2. Description of the Prior Art

Numerous types of devices for tracking the daily activities of a person have been provided in the prior art. For example, U.S. Pat. Nos. 4,916,827; 5,184,303; 5,274,561; 5,525,958 and 5,633,622 all are illustrative of such prior art. While these units may be suitable for the particular purpose to which they address, they would not be as suitable for the purposes of the present invention as heretofore described.

U.S. Pat. No. 4,916,827

Inventor: William H. Rayburn

Issued: Apr. 17, 1990

A flat, ruler-like guide is shaped to be laid over the tables and scales set forth in a trucker's log book. The guide has cut-out portions which outline only those entries in the log book which the trucker needs for making certain calculations. Printed on the face of the guide are equations which the trucker follows in making these calculations.

U.S. Pat. No. 5,184,303

Inventor: Laura J. Link

Issued: Feb. 2, 1993

Vehicle route planning system uses a route planning apparatus to calculate a desired route between start and destination locations. Apparatus provides route information based on the calculated route. The route is calculated in accordance with fixed road path data stored in memory. A user of the system uses input devices to specify "detour" data that define what stored road path data should not be considered in calculating the desired route. A navigation computer allows the system user to designate the detour data as "system detour data" to be used for excluding road path data for all routes calculated for all drivers to all destinations or to designate the user specified detour data as "subsystem detour data" which is used for excluding road path data for calculating some, but fewer than all, routes to be calculated. Preferably, the subsystem detour data includes driver ID associated detour (route calculation) data and/or trip associated detour data. The user designation and entry of different types of detour data allows the system to achieve system flexibility while minimizing the time and effort involved by the user in entering detour data which may be used in calculating several trips.

U.S. Pat. No. 5,274,561

Inventor: Jurgen Adams et al.

Issued: Dec. 28, 1993

An apparatus is described for increasing a fare to a rounded-off amount, in which the fare is determined by an electronic taximeter and prior to the preparation of a voucher in an assigned voucher printout mechanism the amount payable is rounded-off by an increase of the fare amount manually preselectable in predetermined steps, based on an actuation of operating keys. A stepwise or discretely adjustable rounding-off is selectable for printout in the voucher printer in such a way that the voucher shows the sum, formed from the fare+surcharge+additional amount selected by the passenger.

U.S. Pat. No. 5,525,958

Inventor: Hidetaka Negishi et al.

Issued: Jun. 11, 1996

An appointment reminder includes a display for displaying one or more appointment identifiers, the time of day, and the day of week. A keyboard has an appointment key for initiating an appointment setting program and set keys for setting an appointment time. A processor is included for executing the appointment setting program which associates the appointment time with an appointment identifier. The processor also executes an appointment notice program that notifies a user when the appointment time has arrived. A memory is included for storing the appointment time, the appointment identifier, the appointment setting program and the appointment notice program. A clock provides timing for the operation of the processor.

U.S. Pat. No. 5,633,622

Inventor: Robert L. Patterson

Issued: May 27, 1997

A truck driver logging device including a display adapted to depict a time log graph. The time log graph comprises a plurality of rows each corresponding to a duty pertinent to the daily activities of a truck driver. The time log graph further comprises a multiplicity of columns with vertically aligned tick marks depicted thereon. Each tick mark corresponds to a specific time within a twenty-four hour period. A plurality of duty buttons are adapted to graph a line within the corresponding row between two of the tick marks thus displaying the specific time of the day allotted to the associated duty and the end thereof is afforded by the subsequent depression of a different duty key. A control mechanism is adapted to automatically calculate and display the time graphically depicted for each duty and further to automatically calculate and display a running weekly total of time entered during a present week for each duty.

SUMMARY OF THE PRESENT INVENTION

The present invention relates generally to log books for truck drivers and, more specifically, to a device for tracking the daily activities of employees required to keep a log book and printing a daily log of such activities.

A primary object of the present invention is to provide a daily log device that will overcome the shortcomings of prior art devices.

Another object of the present invention is to provide a daily log device which is able to automatically record a daily log for a truck driver or chauffeur.

A further object of the present invention is to provide a daily log device including a printer which is able to provide a printed copy of the daily log.

A yet further object of the present invention is to provide a daily log device wherein the on and off duty times of the user are stored on an internal memory within the device.

A still further object of the present invention is to provide a daily log device including a memory for storing a log for a plurality of days and forming an accummulative log from the stored data.

A further object of the present invention is to provide a daily log device including a clock for tracking the date and time entries made by the user.

A further object of the present invention is to provide a daily log device including additional connection ports for connection of peripheral devices for input of additional data to be combined with the log data.

A still further object of the present invention is to provide a daily log device including an external disk drive for storing the log information on a storage medium such as a computer diskette.

Another object of the present invention is to provide a daily log device that is simple and easy to use.

A still further object of the present invention is to provide a daily log device that is economical in cost to manufacture.

Additional objects of the present invention will appear as the description proceeds.

A daily log device for recording the daily activities of a driver is described by the present invention. The daily log device includes a clock indicating a time and date, a first signal generator for generating a signal representative of the driver being on duty and a second signal generator for generating a signal representative of the driver being off duty. A microprocessor is connected to the clock, the first signal generator and the second signal generator and includes a memory. A printer is connected to the microprocessor for printing the daily log. The microprocessor stores a time and date at which the first signal generator is activated and a time and date at which second signal generator is activated in the memory and calculates a time period between activation of the first and second signal generators. The daily log indicates the time the first signal generator is activated, the time the second signal generator is activated and the calculated time between activation of the first and second signal generators. The first signal generator can also divide the on duty time between times the driver is on duty and driving and times the driver is on duty and not driving. These time periods will also be calculated by the microprocessor and printed on the daily log.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

Various other objects, features and attendant advantages of the present invention will become more fully appreciated as the same becomes better understood when considered in conjunction with the accompanying drawings, in which like reference characters designate the same or similar parts throughout the several views.

DESCRIPTION OF THE REFERENCED NUMERALS

Figure 1:
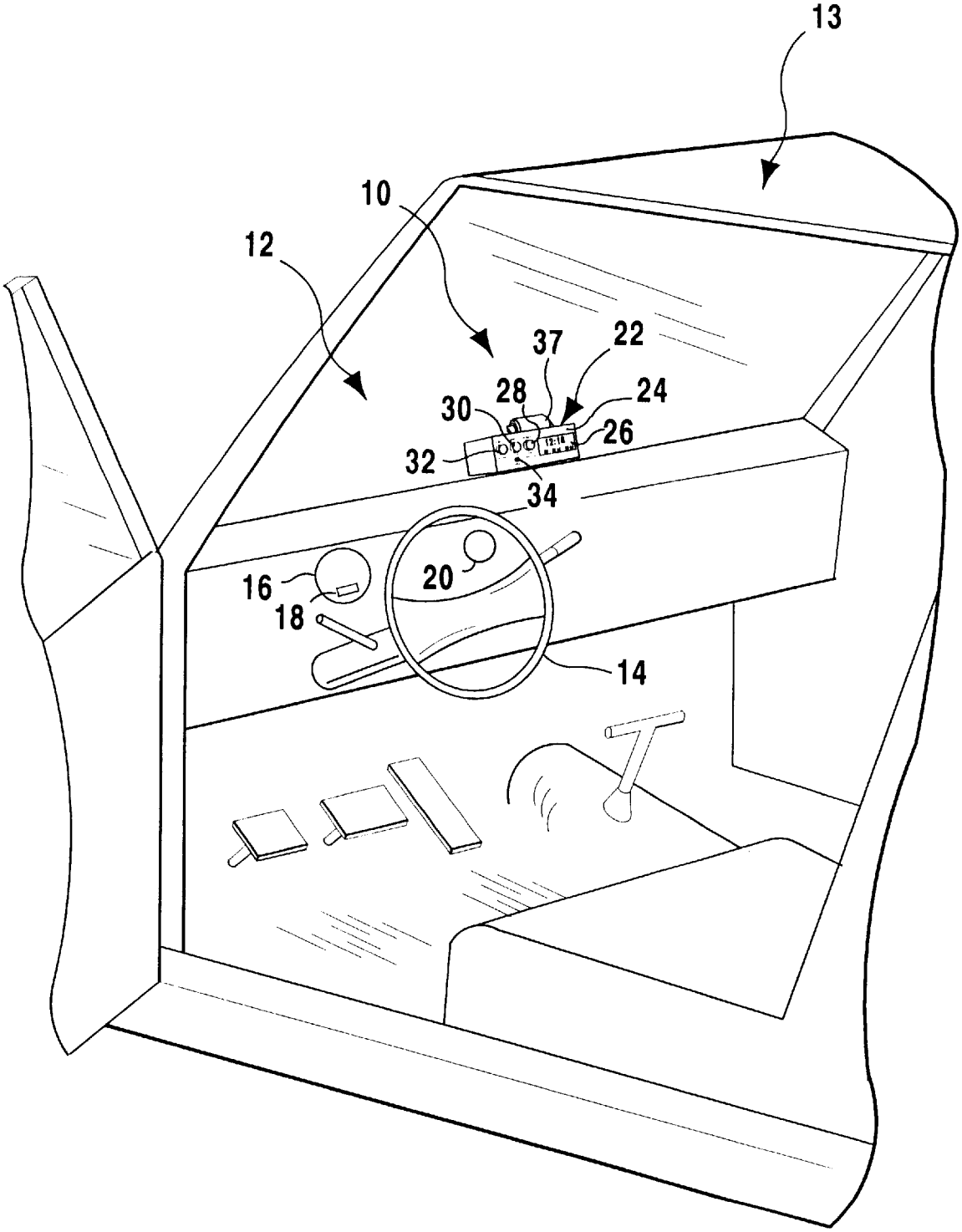
FIG. 1 is a front perspective view of a dashboard of a vehicle on which the daily log device of the present invention is positioned.

Turning now descriptively to the drawings, in which similar reference characters denote similar elements throughout the several views, the Figures illustrate the daily log device of the present invention. With regard to the reference numerals used, the following numbering is used throughout the various drawing figures.

| | |
|---|---|
| 10 | daily log device of the present invention |
| 12 | dashboard of a vehicle |
| 13 | vehicle |
| 14 | steering wheel |
| 16 | speedometer |
| 18 | odometer |
| 20 | gas meter |
| 22 | housing of daily log device |
| 24 | face side of housing of daily log device |
| 26 | clock on face side of housing |
| 28 | on duty/driving button |
| 30 | off duty button |
| 32 | on duty/not driving button |
| 34 | print button |
| 36 | paper tray |
| 37 | roll of paper |
| 38 | time display |
| 39 | entry slot for paper |
| 40 | date display |
| 41 | top side of daily log device |
| 42 | exit slot for paper |
| 44 | time set button |
| 46 | select button |
| 48 | set up button |
| 50 | set down button |
| 52 | back side of daily log device |
| 54 | first connection port |
| 55 | first arrow indicating direction of movement of paper entering the housing |
| 56 | second connection port |
| 57 | second arrow indicating direction of movement of paper exiting the housing |
| 58 | side of daily log device |
| 60 | drive for storage media |
| 62 | diskette release button |
| 64 | printout of log sheet |
| 66 | identification of vehicle in which daily log device is positioned |
| 68 | name of driver of vehicle |
| 70 | date of log entries |
| 72 | daily log printout |
| 74 | row for off duty time |
| 76 | row for on duty/driving time |
| 78 | row for on duty/not driving time |
| 80 | hours off duty |
| 82 | hours on duty and driving |
| 84 | hours on duty not driving |
| 86 | total hours off duty for day |
| 88 | total hours on duty and driving for day |
| 90 | total hours on duty and not driving for day |
| 92 | microprocessor |
| 94 | power source |
| 96 | memory |
| 98 | printer |

DETAILED DESCRIPTION OF THE PREFERRED EMBODIMENT

Turning now descriptively to the drawings, in which similar reference characters denote similar elements throughout the several views, FIGS. 1 through 7 illustrate the daily log device of the present invention indicated generally by the numeral 10.

The daily log device 10 is illustrated in FIG. 1 positioned on the dashboard 12 of a vehicle 13. On the dashboard 12 a steering wheel 14, a speedometer 16, an odometer 18 and a gas meter 20 are visible. The daily log device 10 is positioned in an easily accessible location and includes a housing 22 which is secured to the dashboard 12. On a face side 24 of the housing 22 is a clock display 26 for displaying the time of day and date. Also extending from the face side 24 of the housing 22 is a first button 28 for indicating when the driver is on duty and driving, a second button 30 for indicating when the driver is off duty and a third button 32 for indicating when the driver is on duty and not driving. The first, second and third buttons 28, 30 and 32 are manually activated by the driver upon a change in situation. For example, when the driver enters the vehicle 13 and begins driving the first button 28 is activated to signal the daily log device 10 that the driver is on duty and driving the vehicle. When the driver ends the shift and leaves the vehicle 13, the second button 30 should be activated to indicate that the driver has gone off duty. Should the driver stop the vehicle to make a delivery, the third button 32 should be activated to indicate the driver is on duty and not driving. When each of the first, second and third buttons 28, 30 and 32 are activated, the daily log device 10 will record the time of day and date as displayed by the clock and the button which was activated for later compilation into a daily log.

A print button 34 is also located on the face side 24 of the housing 22. Activation of the print button 34 initiates a printing of a daily log of activities indicating the times at which the driver was on duty and driving, on duty and not driving and off duty. A paper tray 36 extends from a top side of the housing 22 through which the printed log will exit the housing 22.

Figure 2:
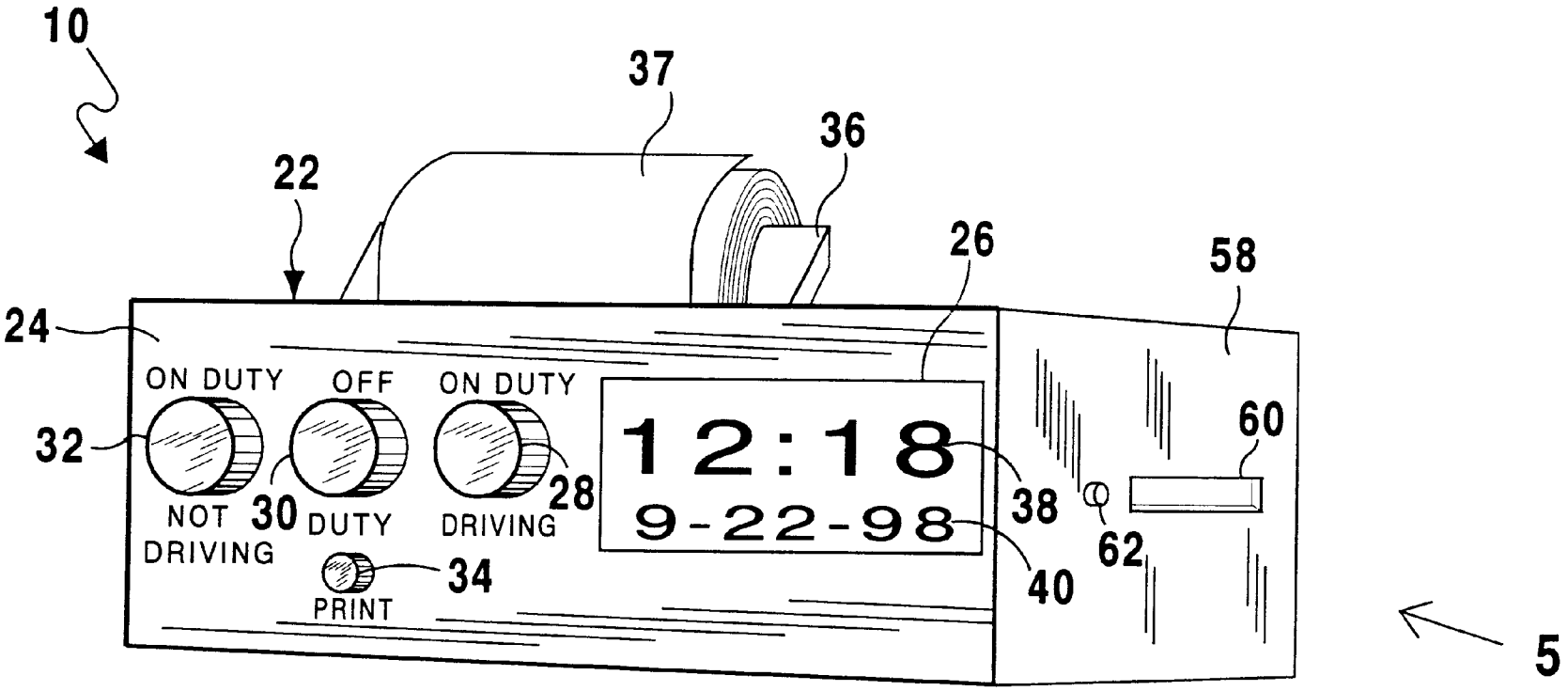
FIG. 2 is an enlarged front view of the daily log device of the present invention.

A perspective view of the daily log device 10 is illustrated in FIG. 2. As can be seen from this figure, Extending from the face side 24 of the housing 22 are the first, second and third buttons 28, 30 and 32. As discussed above, the first button 28 is activated by the driver upon beginning an on duty driving situation, the second button 30 is activated by the driver upon going off duty and the third button 32 is activated by the driver upon beginning an on duty and not driving situation. Also extending from the face side 24 of the housing 22 is a print button 34 to initiate printing of a daily log. The clock 26 is visible on the face side 24 and includes a time display 38 for indicating the time of day and a date display 40 for indicating the date. Extending from the top side of the housing 22 is a paper tray 36 or scroll for holding the paper on which the daily log will be printed. Positioned on a side 58 of the housing 22 is a disk drive 60 for receiving a diskette. When a diskette is placed within the disk drive 60 the information stored within the daily log device 10 will be written thereon for storage of the daily log records associated with the particular daily log device 10. A diskette release button 62 is provided on the side 58 of the housing 22 for releasing the diskette from its position within the disk drive 60.

Figure 3:
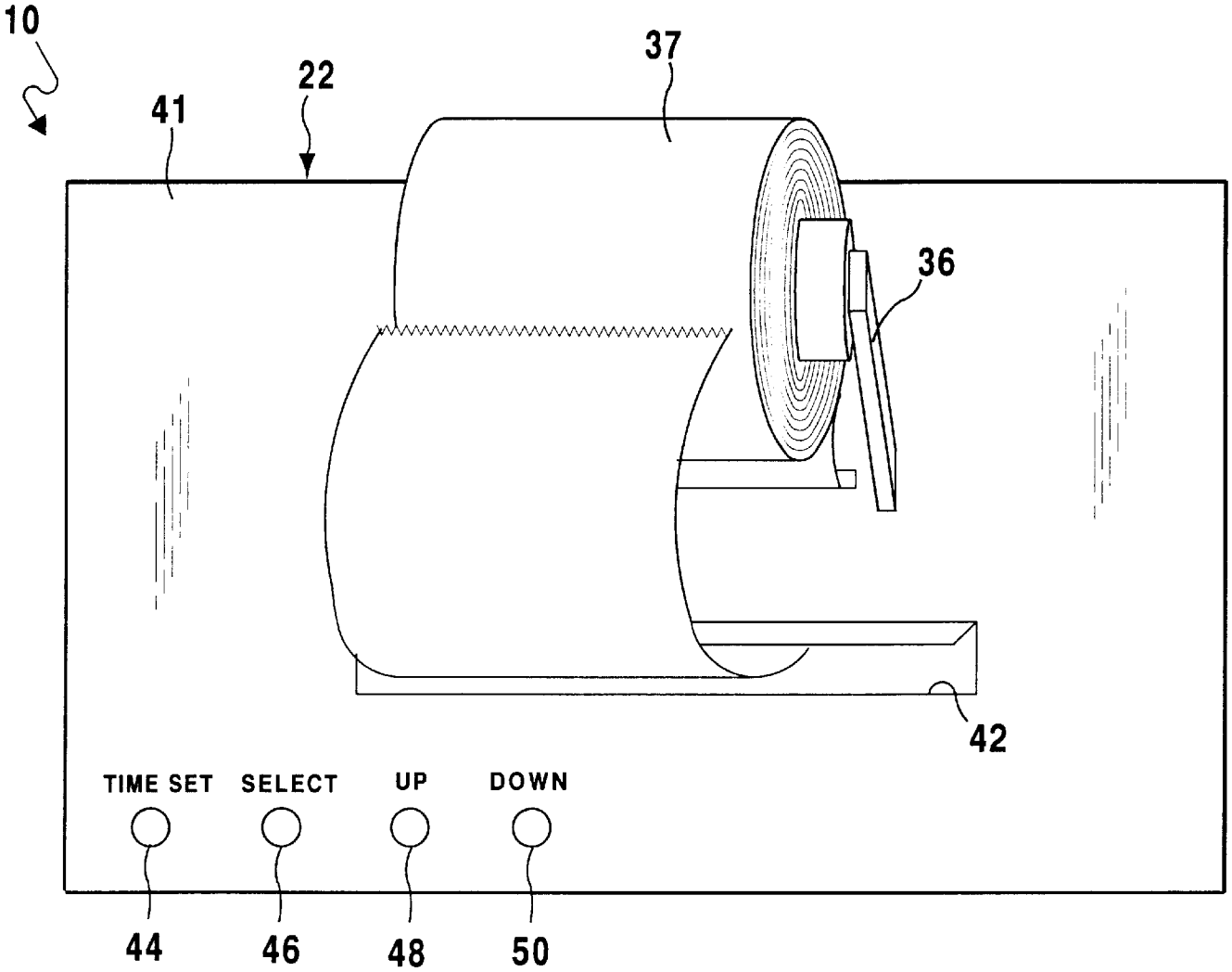
FIG. 3 is a top view of the daily log device of the present invention.

A top view of the daily log device 10 is illustrated in FIG. 3. From this view, it is seen that the top side 41 of the housing 22 includes the paper tray or scroll 36 extending therefrom. Releasably secured thereto is a roll or ream of paper 37. The roll of paper 37 is rotatable about the paper tray 36 and is fed through an entry slot 39 in the top side 41. An exit slot 42 is also located on the top side 41 through which the paper 37 exits the housing 22. Also positioned on the top side 41 are time set buttons. A first time set button 44 is provided to initiate adjusting the time and date displays 38 and 40 of the clock 26. A second time set button 46 is provided to select which portion of the time and date displays 38 and 40, i.e. hour, minute, month, day or year, needs to be set. A third time set button 48 is provided to increase the selected portion of the time and date displays 38 and 40 and a fourth time set button 50 is provided to decrease the selected portion of the time and date displays 38 and 40.

Figure 4:
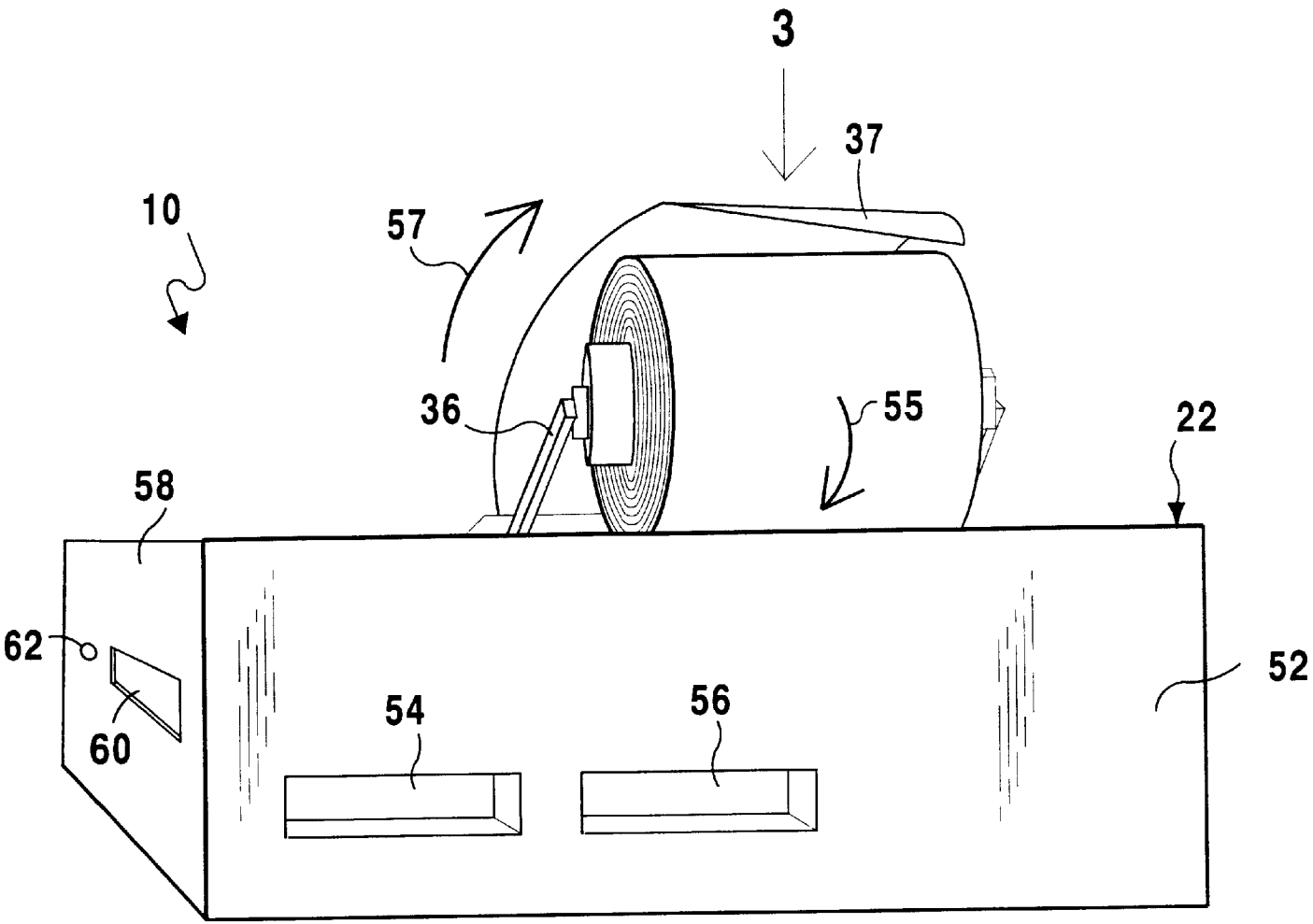
FIG. 4 is a back side view of the daily log device of the present invention.

A view of the back side 52 of the housing 22 of the daily log device 10 is illustrated in FIG. 4. On the back side 52 of the housing 22 are a first connection port 54 and a second connection port 56. The first and second connection ports 54 and 56 provide for the connection of external devices to the daily log device 10. Such devices include but are not limited to tape backup devices, display devices to obtain a visual display of the daily log entries stored in a memory 96 within the housing, a key board for inputting additional data, a microprocessor for reprogramming the controller within the housing, a telephone connection for downloading information to or uploading information from the daily log device 10 from a remote device, any other type of backup device, etc. Also shown in this figure is the roll of paper 37 releasably secured to the paper tray 36. A first arrow 55 indicates the direction of movement of the paper 37 as it enters the housing 22 through the entry slot and a second arrow 57 indicating the direction of movement of the paper 37 as it exits the housing through the exit slot. The disk drive 60 and diskette release button 62 are also shown positioned on the side 58 of the housing 22.

Figure 5:
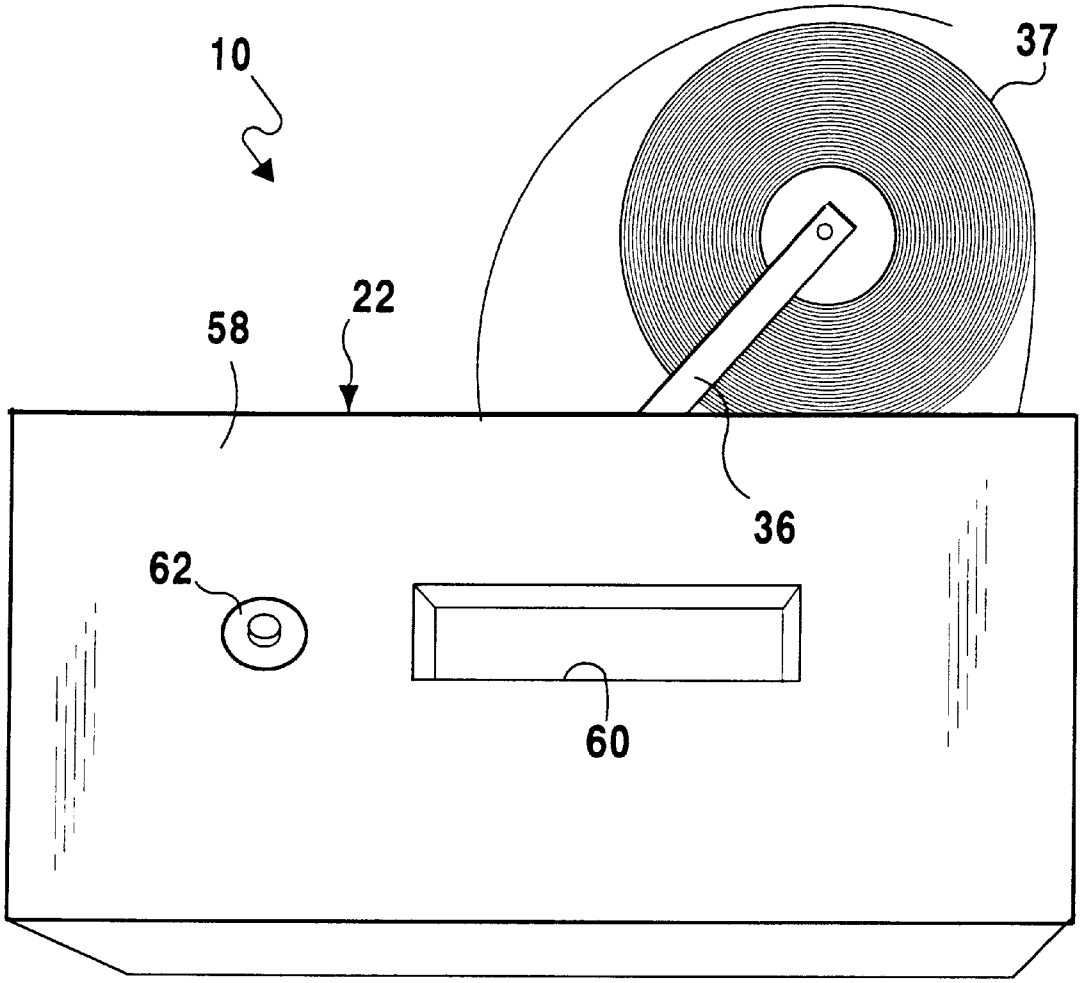
FIG. 5 is a side view of the daily log device of the present invention.

A side view of the housing is illustrated in FIG. 5. This view illustrates the disk drive 60 and diskette release button 62 positioned thereon. The paper tray 36 and roll of paper 37 releasably attached thereto are also seen from this view.

Figure 6:
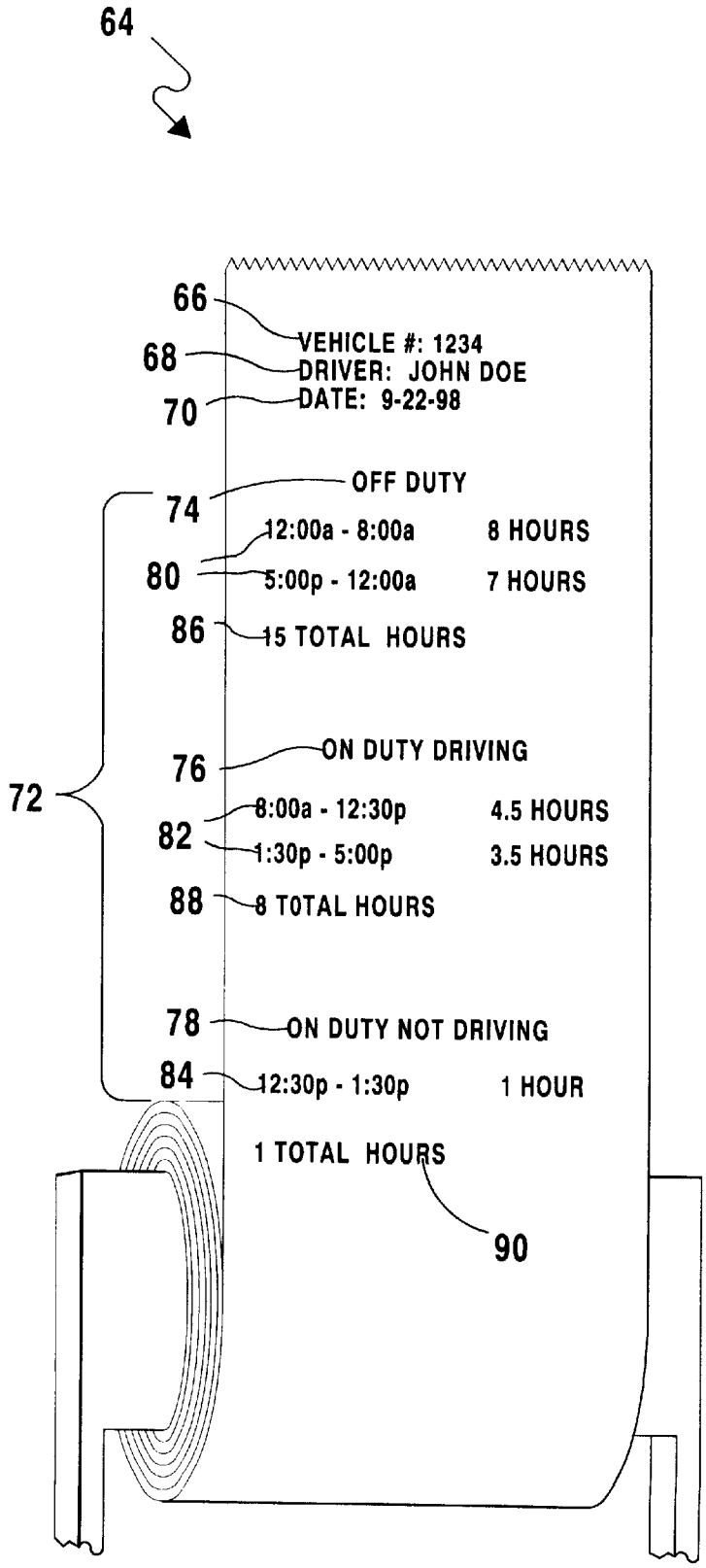
FIG. 6 is a front view of a daily log printout produced by the daily log device of the present invention.

A printout of a daily log 64 is illustrated in FIG. 6. At the top of each printout of the daily log 64 is a listing of the vehicle number 66, the name of the vehicle driver 68 and the date 70 on which the activities listed on the log report occurred. The driver 68 is able to be identified by the device by either downloading the information to the daily log device 10 through connection of an external device to one of the first and second connection ports or the specific daily log device 10 may be preprogrammed for use by the individual driver. Alternatively, the driver's name may be deleted from the daily log report 64 and thus the details of the vehicle usage for the particular date can be detailed by the log report 64. Printed below the vehicle number 66, drivers name 68 and date 70 is a listing 72 of the activities occurring on the date printed 70.

Immediately below the date 70 is printed "OFF DUTY" identified by the numeral 74 and indicating that the times at which the driver was off duty or the vehicle was not in operation are printed below. Identified by the numeral 80 are the time period during which the driver was off duty or had activated the second button and a calculation of the total time within the listed time periods. Printed below the time periods 80 and identified by the numeral 86 is a total of the total time of all the time periods listed. In the example illustrated, the driver was off duty from 12:00 am to 8:00 am for a period of 8 hours and from 5:00 pm to 12:00 am for a period of 7 hours. The total time 86 listed is thus 15 hours.

Immediately below the data indicating the "OFF DUTY" times of the driver a heading indicating the "ON DUTY DRIVING" periods and identified by the numeral 76 is printed. Identified by the numeral 82 are the time period during which the driver was on duty and driving the vehicle and a calculation of the total time within the listed time periods. Printed below the time periods 82 and identified by the numeral 88 is a total of all the time periods listed. In the example illustrated, the driver was on duty and driving from 8:00 am to 12:30 p.m. for a period of 4.5 hours and from 1:30 pm to 5:00 am for a period of 3.5 hours. The total time 88 listed is thus 8 hours.

Immediately below the data indicating the "OFF DUTY" times of the driver a heading indicating the "ON DUTY NOT DRIVING" periods and identified by the numeral 78 is printed. Identified by the numeral 84 is the time period during which the driver was on duty and not driving the vehicle and a calculation of the total time within the listed time periods. Printed below the time periods 84 and identified by the numeral 90 is a total of all the time periods listed. In the example illustrated, the driver was on duty and not driving from 12:30 p.m. to 1:30 p.m. for a period of 1 hour. The total time 90 listed is thus 1 hour.

This list is printed for each day whereby a number of days can be printed at any one time. When activating the print button a daily log 64 for all days not previously printed can be printed. If the information is downloaded to a diskette placed in the disk drive 60 or to another recording mechanism connected to one of the first and second connection ports the information may be printed at any time by reading the information from the storage medium on which it is stored.

Figure 7:
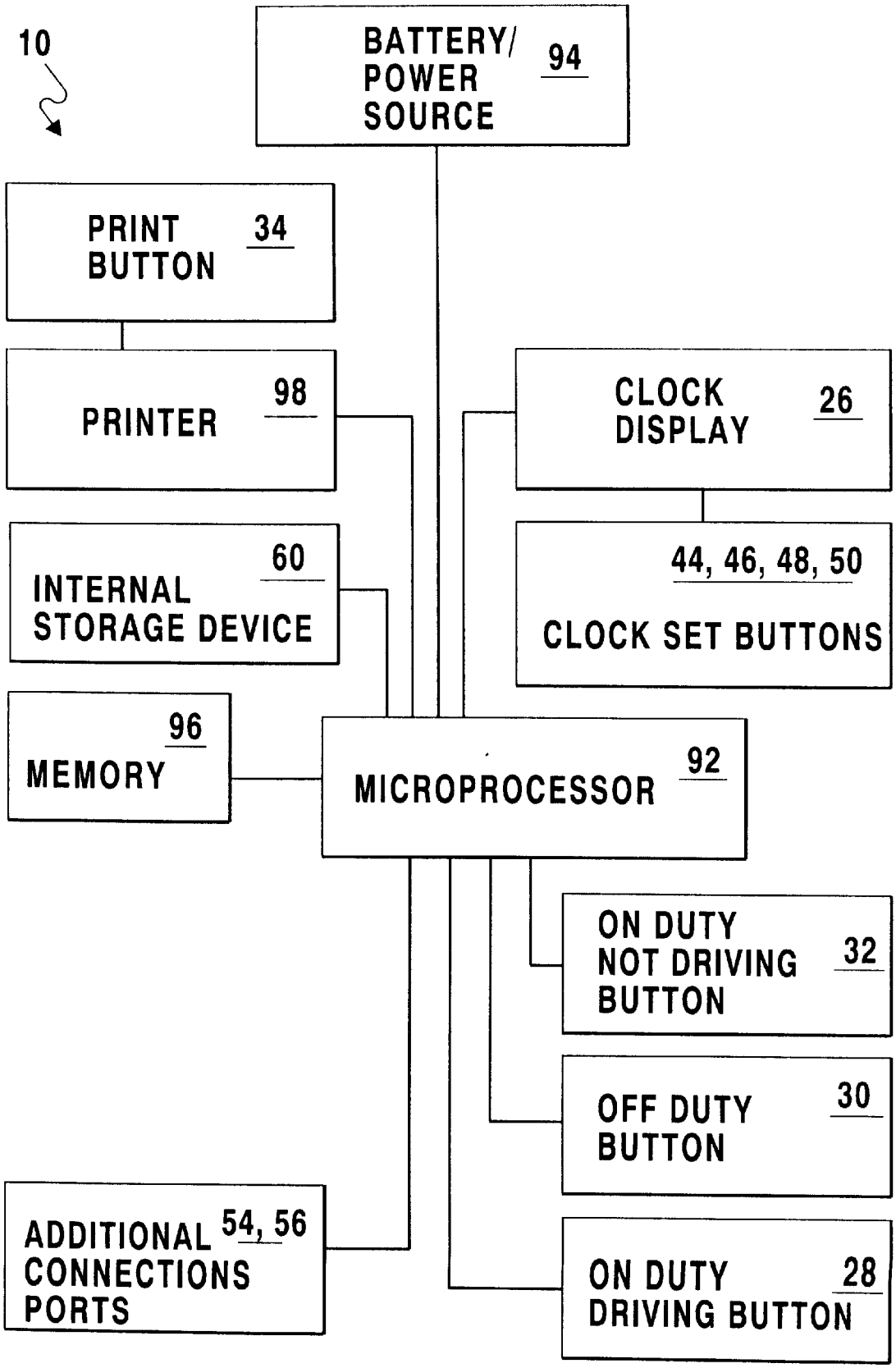
FIG. 7 is a block diagram of the daily log device of the present invention.

A block diagram illustrating the internal components of the daily log device 10 are illustrated in FIG. 7. As is seen from this figure, the daily log device 10 includes a microprocessor 92. Connected to the microprocessor is a power source 94 which can either be an internal power source or the daily log device 10 can be attached to and receive power from the battery of the vehicle in which it is placed. The microprocessor 92 is also connected to a memory 96 for storing all information entered by the user as well as a printer 98 for use in printing out the daily log reports 64. The print button 34 is connected to the printer 98 to initiate transmission of the information to be printed in the daily log report 64 from the microprocessor to the printer 98. The first, second and third buttons 28, 30 and 32 are connected to deliver a signal to the microprocessor 92. The clock 26 is connected to and controlled by the microprocessor 92 wherein the time and date displayed on the clock is transmitted to the microprocessor 92 each time one of the first, second and third buttons 28, 30 and 32 are activated. The clock set buttons 44, 46, 48 and 50 are connected to control the clock 26. The first and second connection ports 54 and 56 as well as the internal disk drive 60 are also connected to the microprocessor 92.

Figure 8B:
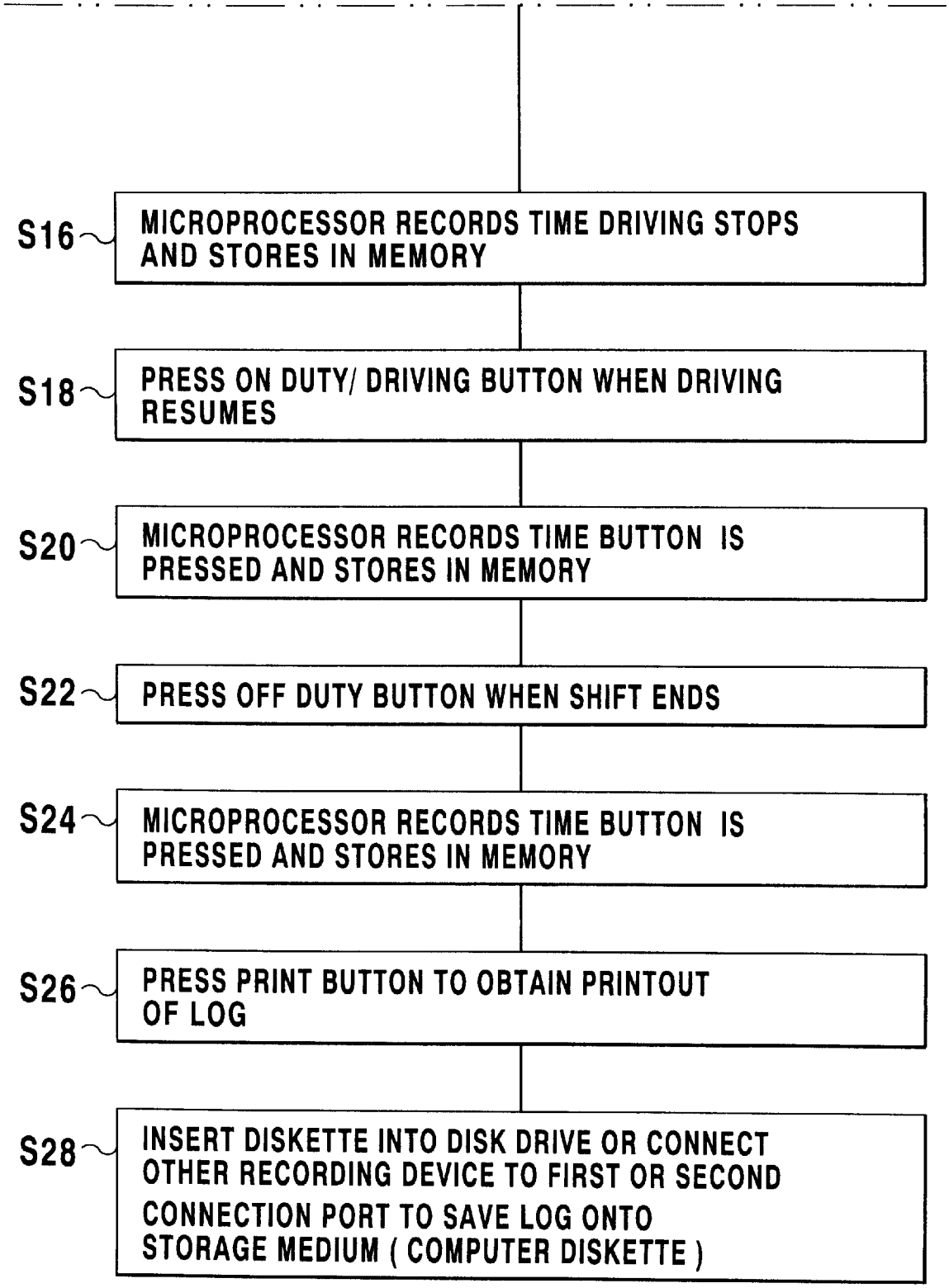
FIG. 8 is a flow chart illustrating the operating process of the daily log device of the present invention.

The operation of the daily log device 10 will now be described with reference to the figures and specifically FIG. 8. In operation, the daily log device 10 is positioned on the dashboard 12 of a vehicle 13 which it is being used to monitor as described in step S2. Once positioned, the time set button 44 is activated to correct the time and date being displayed as stated in step S4. The time set button 44 causes the hour digit of the time to blink. The up and down buttons 48 and 50 on the top side 41 of the daily log device 10 are then pressed to set the correct hour and once the correct hour is set the select button 46 is pressed as discussed in steps S6 and S8. At this time the minutes digits on the clock 26 are caused to blink. The up and down buttons 48 and 50 on the top side 41 of the daily log device 10 are then pressed to set the correct minute and once the correct minute is set the select button 46 is pressed again. This causes the month digits on the clock 26 to blink. The up and down buttons 48 and 50 on the top side 41 of the daily log device 10 are then pressed to set the correct month and once the correct month is set the select button 46 is pressed again. This causes the day digits on the clock 26 to blink. The up and down buttons 48 and 50 on the top side 41 of the daily log device 10 are then pressed to set the correct day and once the correct day is set the select button 46 is pressed again. This causes the year digits on the clock 26 to blink. The up and down buttons 48 and 50 on the top side 41 of the daily log device 10 are then pressed to set the correct year and once the correct year is set the select button 46 is pressed again. If the correct time and date are already displayed by the clock then the clock buttons do not need to be activated or pressed. If any individual element of the time and date are already displayed by the clock then the select button 46 will cause the bypassing of that element and the up and down buttons 48 and 50 need not be pressed. The daily log device 10 is now ready to be activated.

When the driver of the vehicle 13 begins a shift, the on duty/driving button 28 should be activated or pressed as discussed in step S10. This will send a signal to the microprocessor 92 that the driver is beginning a shift and is driving. Data indicating such will be stored in memory 96 and the microprocessor 92 will also store the date and time which the on duty/driving button 28 was pressed as stated in step S12. Upon parking the vehicle 13 such as when reaching the destination and beginning to unload the vehicle, the driver will press the on duty/no driving button 32 as described in step S14. This will send a signal to the microprocessor 92 that the driver is stopping the vehicle. Data indicating such will be stored in memory 96 and the microprocessor 92 will also store the date and time which the on duty/driving button 28 was pressed as stated in step S16. The microprocessor 92 will record the date and time the on duty/not driving button 32 was pressed as ending the period of time the driver was on duty and driving and store this information in the memory 96. When the driver reenters the vehicle 13 and begins driving again, the on duty/driving button must be pressed again as stated in step S18. This will send a signal to the microprocessor 92 that the driver is resuming driving. Data indicating such will be stored in memory 96 and the microprocessor 92 will also store the date and time which the on duty/driving button 28 was pressed as stated in step S20. The microprocessor 92 will record the date and time the on duty/driving button 28 was pressed as ending the period of time the driver was on duty and not driving and store this information in the memory 96. When the driver exits the vehicle 13 and ends the shift, the off duty button 30 must be pressed as stated in step S22. This will send a signal to the microprocessor 92 that the driver is ending the shift and going off duty. Data indicating such will be stored in memory 96 and the microprocessor 92 will also store the date and time which the off duty button 30 was pressed as stated in step S24. The microprocessor 92 will record the date and time the off duty button 30 was pressed as ending the period of time the driver was on duty and driving and store this information in the memory 96. At this time or at any time in the future, the driver can press the print button 34 and print a daily log record indicating the daily log of the driver since the last printout as described in step S26. The daily log will indicate the time of day and total hours that the driver was off duty, on duty and driving and on duty and not driving. This information can then be automatically saved by inserting a diskette into the disk drive 60 or connecting a recording device to the first or second connection ports 54 or 56 as discussed in step S28. The microprocessor 92 is programmed to automatically save this information when it senses a diskette is inserted into the disk drive or a recording device has been connected to one of the first or second connection ports 54 or 56.

From the above description it can be seen that the daily log device of the present invention is able to overcome the shortcomings of prior art devices by providing a daily log device which is able to automatically record a daily log for a truck driver or chauffeur and provide a printed copy of the daily log. The daily log device includes a memory for storing a log for a plurality of days and a clock for tracking the date and time entries made by the user. The daily log device forms an accumulative log from the stored data and stores the on and off duty times of the user in an internal memory within the device. The daily log device also includes additional connection ports for connection of peripheral devices for input of additional data to be combined with the log data and an external disk drive for storing the log information on a storage medium such as a computer diskette. Furthermore, the daily log device of the present invention is simple and easy to use and economical in cost to manufacture.

It will be understood that each of the elements described above, or two or more together may also find a useful application in other types of methods differing from the type described above.

While certain novel features of this invention have been shown and described and are pointed out in the annexed claims, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is new and desired to be protected by Letters Patent is set forth in the appended claims:

1. A daily log device positioned within a vehicle for recording the daily activities of a driver, said daily log device comprising:

a) a display for showing the date and a clock indicating a time and date including means for setting the time and date on said clock;

b) first and second manually activated buttons for generating signals representative of the driver being on duty driving and on duty not driving, respectively;

c) a third manually activated button for generating a signal representative of the driver being off duty;

d) microprocessor means connected to said clock and said buttons and including a memory;

e) means for printing the daily log, wherein said microprocessor stores a time and date at which said first means is activated and a time and date at which said second means is activated in said memory and calculates a time period between activation of said first and second means, said daily log indicating the time said first means is activated, said time said second means is activated and said calculated time between activation of said first and second means;

f) a diskette drive for accommodating a diskette to store data downloaded from said microprocessor;

g) said microprocessor being programmed to automatically download the contents of said memory on said diskette upon insertion into said disk drive;

h) said device consisting of a housing which is normally closed while in use, said clock and microprocessor being positioned within said housing and said first, second and third buttons extending from the outside of said housing, said housing also having on the outside thereof a manually activated fourth button to initiate printing of the daily log; and i) said housing including first and second slots extending through a top side thereof and said device further includes a supply of paper and a paper holder for holding said supply of paper and providing said supply of paper to said printer for printing the daily log thereon, said supply of paper entering said housing through said first slot for receipt by said printer and exiting said housing through said second slot.

2. The daily log device as recited in claim 1, wherein said first means includes a first signal generator for generating a signal that the driver is on duty and driving the vehicle and a second signal generator for generating a signal that the driver is on duty and not driving the vehicle.

3. The daily log device as recited in claim 1, further comprising a supply of paper and a paper holder for holding said supply of paper and providing said supply of paper to said printer for printing the daily log thereon.

4. The daily log device as recited in claim 1, wherein said microprocessor receives power from the battery of the vehicle in which the device is positioned.

5. The daily log device as recited in claim 1, wherein said device is associated with the vehicle in which it is positioned and includes a code identifying the vehicle stored in said memory, said code being printed on each daily log to identify the device and vehicle with which the daily log is associated.

6. The daily log device as recited in claim 1, wherein said device is associated with a particular driver, a name of the driver being stored in said memory and printed on each daily log to associate the driver and device with the daily log.

7. The daily log device as recited in claim 1, wherein said device is associated with a particular driver, a name of the driver being stored in said memory and printed on each daily log to associate the driver and device with the daily log.

8. The daily log device as recited in claim 7, wherein said device is associated with the vehicle in which it is positioned and includes a code identifying the vehicle stored in said memory, said code being printed on each daily log to identify the device and vehicle with which the daily log is associated.

* * * * *